US006299248B1

(12) United States Patent
Gennaro et al.

(10) Patent No.: US 6,299,248 B1
(45) Date of Patent: Oct. 9, 2001

(54) POSTURE SYSTEM

(76) Inventors: Richard Gennaro, 560 North Ave., Pleasant Valley, NY (US) 12569; Jay Lipoff, 1246 Salt Springs Rd., Chittenango, NY (US) 13037

( * ) Notice: Subject to any disclaimer, the term of this patent is extended or adjusted under 35 U.S.C. 154(b) by 0 days.

(21) Appl. No.: 09/422,177

(22) Filed: Oct. 22, 1999

(51) Int. Cl.[7] ..... A47C 7/42

(52) U.S. Cl. ..... 297/230.13; 297/219.1; 297/228.1; 297/230.1; 297/229; 297/284.5; 297/397; 297/DIG. 6; 5/632

(58) Field of Search ..... 297/279.1, 228.1, 297/229, 230.13, 230.1, 284.5, DIG. 6, 397; 5/632, 633, 643, 657

(56) References Cited

U.S. PATENT DOCUMENTS

| | | | | |
|---|---|---|---|---|
| 3,446,531 | * | 5/1969 | Froelich | 297/284.5 |
| 4,097,086 | * | 6/1978 | Hudson | 297/397 X |
| 4,206,945 | * | 6/1980 | Kifferstein | 297/DIG. 6 X |
| 4,362,334 | * | 12/1982 | Ross et al. | 297/DIG. 6 X |
| 4,383,713 | * | 5/1983 | Roston | 297/397 X |
| 4,471,993 | * | 9/1984 | Watson | 297/284.5 |
| 4,506,929 | | 3/1985 | Josefek | 297/230.1 |
| 4,597,386 | * | 7/1986 | Goldstein | 297/284.5 X |
| 4,597,605 | | 7/1986 | Gilbert | 297/229 |
| 4,634,176 | * | 1/1987 | Scott | 297/284.5 |
| 4,676,376 | * | 6/1987 | Keiswetter | 297/228.1 X |
| 4,783,120 | | 11/1988 | Kiechlin | 297/230.1 |
| 4,824,169 | * | 4/1989 | Jarrell | 297/230.1 X |
| 4,828,320 | * | 5/1989 | Saiger | 297/229 |
| 4,862,536 | * | 9/1989 | Pruit | 297/284.5 |
| 4,876,755 | * | 10/1989 | Parrish | 297/284.5 X |
| 5,029,928 | | 7/1991 | Huber | 296/63 |
| 5,129,705 | * | 7/1992 | Wray | 297/397 |
| 5,137,335 | * | 8/1992 | Marten | 297/230.1 X |
| 5,154,477 | * | 10/1992 | Lacy | 297/397 |
| 5,251,957 | * | 10/1993 | Lemens | 297/230.1 |
| 5,297,848 | | 3/1994 | Grinneu | 297/284.5 X |
| 5,345,633 | * | 9/1994 | Harnish | 297/397 X |
| 5,384,923 | | 1/1995 | Hwang et al. | 5/419 |
| 5,388,295 | | 2/1995 | Sarkozi | 5/630 |
| 5,456,519 | * | 10/1995 | Davis | 297/DIG. 6 X |
| 5,503,456 | * | 4/1996 | Rossini | 297/284.5 X |
| 5,544,378 | * | 8/1996 | Chow | 297/397 X |
| 5,702,153 | * | 12/1997 | Pliska | 297/230.1 X |
| 5,709,431 | * | 1/1998 | Horn | 297/219.1 |
| 5,806,925 | * | 9/1998 | Hanley | 297/219.1 X |
| 5,816,654 | * | 10/1998 | Ellis | 297/230.13 X |
| 5,915,789 | * | 6/1999 | Ponce De Leon, III | 297/DIG. 6 X |
| 5,941,599 | * | 8/1999 | Roberts | 297/DIG. 6 X |
| 5,964,504 | * | 10/1999 | Hogan et al. | 297/397 |

FOREIGN PATENT DOCUMENTS

| | | | | |
|---|---|---|---|---|
| 2856366 | * | 2/1980 | (DE) | 297/284.5 |
| 1101008 | * | 9/1955 | (FR) | 297/230.1 |
| 668983 | * | 12/1965 | (FR) | 297/229 |
| 1457481 | * | 11/1966 | (FR) | 297/229 |
| 514644 | * | 11/1939 | (GB) | 297/229 |

* cited by examiner

*Primary Examiner*—Peter M. Cuomo
*Assistant Examiner*—Rodney B. White

(57) ABSTRACT

A posture system with a lumbar pad and a cervical pad either one or both of which may be used. The lumbar and cervical pads may be supported on a chair by arms which can be bent to a desired position which position is retained until sufficient force is applied to place the arms into a different position. A back cover held on the back of a chair by a pocket at the end of back cover may also used with or be used in place of the arms. Hook and loop material on the lumbar pad and the cervical pad and the back cover provides support for the lumbar pad and the cervical pad. The lumbar pad and the cervical pad wrap up into the back cover which is held in the pocket for carrying.

8 Claims, 6 Drawing Sheets

POSTURE SYSTEM

BACKGROUND OF THE INVENTION

1. Field of the Invention

This invention relates to a posture system and more particularly to a posture system that includes a plurality of posture pads that can be used singularly and together and which can be secured to a chair back by two separate distinct ways and which can be carried by a person on a train or plane or used in an office.

2. Prior Art and Objects

Various posture devices have been previously developed. Most address only the lumbar region and ignore the cervical region. Some attempt to provide a portable device which is important, as often the greatest need for posture correction occurs while traveling. Frequently, the applicability of the devices to a wide variety of chairs is also inadequate.

The Josefek Pat., U.S. Pat. No. 4,506,929 pertains only to a lumbar cushion. It is a portable unit designed to be readily carried for train and plane usage. Josefek uses a vertical central ridge that mates with the spinal channel to provide, according to the patent, lumbar support which enables the muscles to maintain their normal lordodic curvature in the seated position. Josefek provides no cervical cushion. It is a singular back cushion directed solely to the lumbar region.

The Gilbert Pat., U.S. Pat. No. 4,597,605 does not have ergonomic advantages but rather is merely a seat and a back cushion to provide softness when using a hard chair such as a folding metal chair. It combines a tote bag with the seat cushion.

The Kiechlin patent is also not an ergonomic device but rather a seat cushion that in one embodiment can also include a back cushion. A pocket or pouch that is detachable is included. Otherwise, Kiechlin is a cushion on a strap except that a hinged back cushion that folds up from one edge of the seat cushion may also be provided.

The Sarkozi patent discloses a seat and back pad of individual parallel rounded pads that can be varied as to where and to what degree cushioning is provided. The plurality of cylindrical pads are joined together by hinge regions to form the seat and back pad. The seat and back pad can be folded at the hinge regions between the individual pads. The seat and back pad can be doubled to form a cushion in the cervical area but the result is not a true cervical pad. Hook and loop material may be used to hold the seat and back pad in place.

The Davis Pat., U.S. Pat. No. 5,456,519, is an ergonomic invention but provides only lumbar support. Davis uses two sections, namely a seat cushion and a back cushion which are connected for use by hook and loop material. Hook and loop material are also used to secure both pads to a chair.

The Huber Pat., U.S. Pat. 5,029,928, pertains to a seat for a passenger riding in the open back box of a pick up truck. Huber provides a folding design but not a compact design to be carried.

Hwang et. al.,U.S. Pat. 5,384,923, pertains of a camping seat and mat. The mat is an extension of the seat. Straps are used to hold a back hinged to the seat cushion but no cervical or lumbar cushions are shown.

The Grinnell Pat., U.S. Pat. No. 5,297,848, is directed to an orthopedically correct adjustable seating cushion. A lumbar cushion is provided but no cervical cushion is included. The base and the back are connected by a hinge which permits folding the base and the back together. A handle permits carrying. Straps are used to hold the back cushion in place on the chair.

The above patents fail to provide a flexible system that permits locating both a lumbar and a cervical cushion at the most desirable position. A system is also not provided that permits use of a posture pad that can be affixed to the back of a chair by a self-contained means. Posture pads that can be affixed to a broad range of seating situations are also not shown.

According, it is an object of the present invention to provide a posture system that provides both lumbar and cervical support.

It is still another object of the present invention to provide a posture system that is portable.

It is still another object of the present invention to provide a posture system that is readily attachable to a wide variety of chairs.

It Is still another object of the present invention to provide a posture system that is simple to use.

It is still another object of the present invention to provide a posture system that is flexible so as to be able to locate both the lumbar pad and the cervical pad in the most desirable position.

It is still another object of the present invention to provide a posture system that is flexible thereby permitting use of a part of the system as well as permitting use of all of the system while also permitting the attachment of posture pads in different ways.

It is still another object of the present invention to provide a posture system with a carrying case that can be used as part of the posture device.

It is still another object of the present invention to provide a posture device that can be folded into a convenient, easily carried package.

It is still another object of the present invention to provide a posture device that is economical to produce and is also durable.

These and other objects and advantages of the present invention will become apparent to those of ordinary skill in the art as the description thereof proceeds.

SUMMARY OF THE INVENTION

At least one posture pad is provided and usually two posture pads are provided which are a cervical pad and a lumbar pad. Each posture pad has hook and loop material on its back surface and each posture pad has a pair of arms that can be bent to virtually any desired position to wrap around a chair back to permit the pads to be held in place. By bending the arms back, the posture pad may be removed. A carrier case serves both as a means for mounting the lumbar pad and the cervical pad and has a pocket at one end to be slid over the top of the back of a chair. The carrier case has two sections, namely the pocket previously mentioned and a back cover which hangs down against the bank of the chair from the pocket on the inside of a chair. A strip of hook and loop material extends along the center of the carrier case to engage the hook and loop material on the back surface of the cervical pad and the back surface of the lumbar pad. The lumbar pad and the cervical pad may be mounted on the back cover and the arms need not be used but may be used for added support. The back cover may also be rolled up with both the cervical pad and the lumbar pad and may then be folded into the pocket for easy carrying.

BRIEF DESCRIPTION OF THE DRAWINGS

The present invention may be more fully understood from the following detailed description taken together with the accompanying drawings wherein similar reference characters refer to similar elements throughout and in which.

DESCRIPTION OF THE PREFERRED EMBODIMENT

Figure 1A:
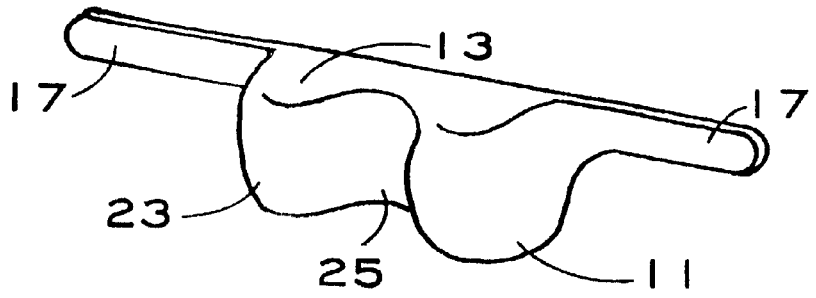
FIG. 1*a* is a perspective view of the front of a cervical pad in accordance with the present invention but with the arms stretched out from the cervical pad along a common longitudinal line.
Figure 1B:
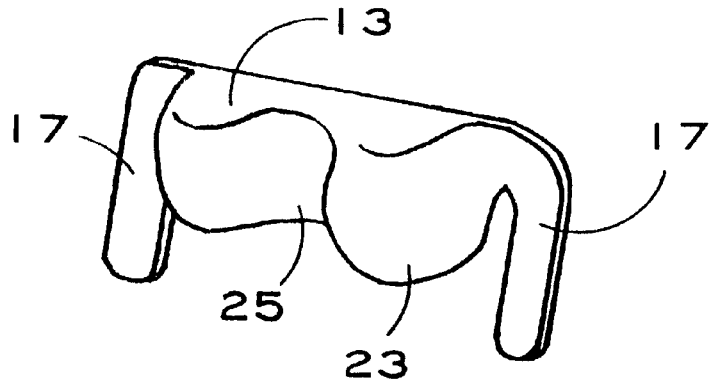
FIG. 1*b* is a perspective view of the front of the cervical pad in accordance with the present invention similar to FIG. 1*a* but with the arms folded down generally parallel to one another.
Figure 1C:
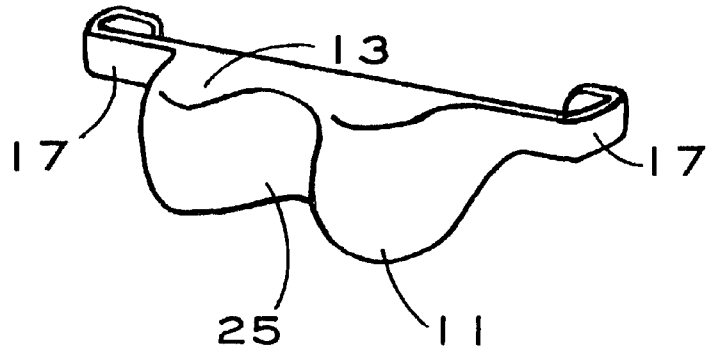
FIG. 1*c* is a perspective view of the front of the cervical pad in accordance with the present invention similar to FIGS. 1*a* and 1*b* but with the arms bent around to the back into generally U-shaped form.
Figure 2A:
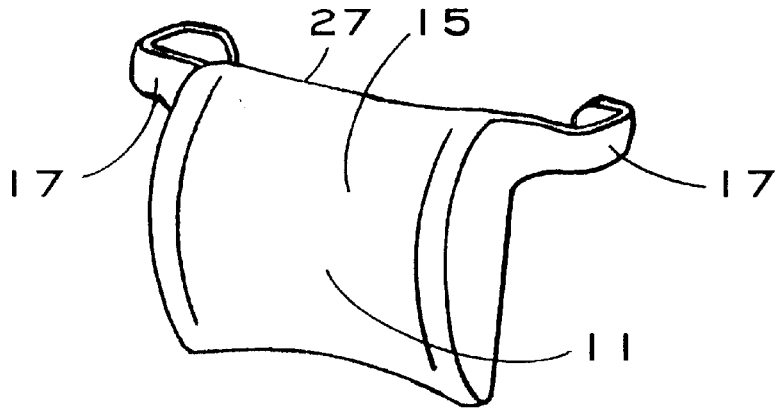
FIG. 2*a* is a perspective view of the front of the lumbar pad in accordance with the present invention with the arms bent around to the back similar to the arms shown in FIG. 1*c*.
Figure 2B:
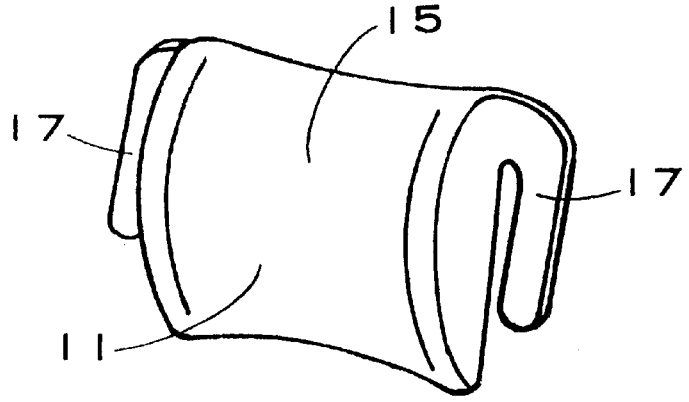
FIG. 2*b* is a perspective view of the front of the lumbar pad in accordance with the present invention similar to FIG. 2*a* but with the arms bent down generally parallel to one another.
Figure 2C:
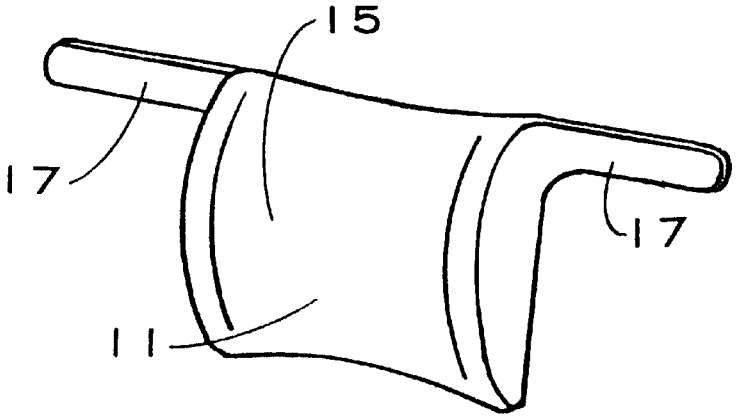
FIG. 2*c* is a perspective view of the lumbar pad in accordance with the present invention similar to FIGS. 2*a* and 2*b* but with the arms stretched out form the lumbar pad along a common longitudinal line.

With reference now to the drawings, and in particular to FIGS. 1*a*, 1*b* and 1*c* and to FIGS. 2*a*, 2*b* and 2*c* thereof, posture pads 11 are shown. More specifically, in FIGS. 1*a*, 1*b* and 1*c* a cervical pad 13 is shown. In FIGS. 2*a*, 2*b* and 2*c* a lumbar pad 15 is shown. In FIG. 1*a*, the cervical pad 13 is shown with arms 17 extending from it. The cervical pad 13 itself is similar to known cervical pads is use. The arms 17, however, are unique to the present invention. Similarly, the lumbar pad 15 shown in FIGS. 2*a*, 2*b* and 2*c* is similar to known lumbar pads. The arms 17, however, extending from The lumbar pad 15 are the same as the arms 17 extending from the cervical pad 13, and are unique to the present invention. The arms 17 are formed with an internal wire that can be repeatedly bent but when bent stay in the position to which bent until sufficient force is applied to bend the wire again. Such deformable and bendable wire is commercially available.

In FIG. 1*c* the arms 17 of the cervical pad 13 are bent around with two right angle bends so that the ends of the arms 17 are generally parallel to the cervical pad 13. In this fashion, the arms 17 may be bent about the back 19 of a chair 21 to retain the cervical pad 13 in place.

In FIG. 2*a*, the arms 17 of the lumbar pad 15 are shown bent around with two right angle bends forming a U-shape so that the ends of the arms 17 are generally parallel to the lumbar pad 15. As with the cervical pad 13, this permits the arms 17 to be bent about the back 19 of a chair 21 to retain the lumbar pad 13 in place.

The cervical pad 13 includes two side pads 23 with a indentation 25 between them. The neck is placed into the indentation 25 and the head is supported between the two side pads 23. The lumbar pad 15 extends outwardly at its upper edge 27 and then slopes toward the back 29 so that the lumbar pad 15 applies pressure to the lower spine just above the base of the spine.

Figure 3:
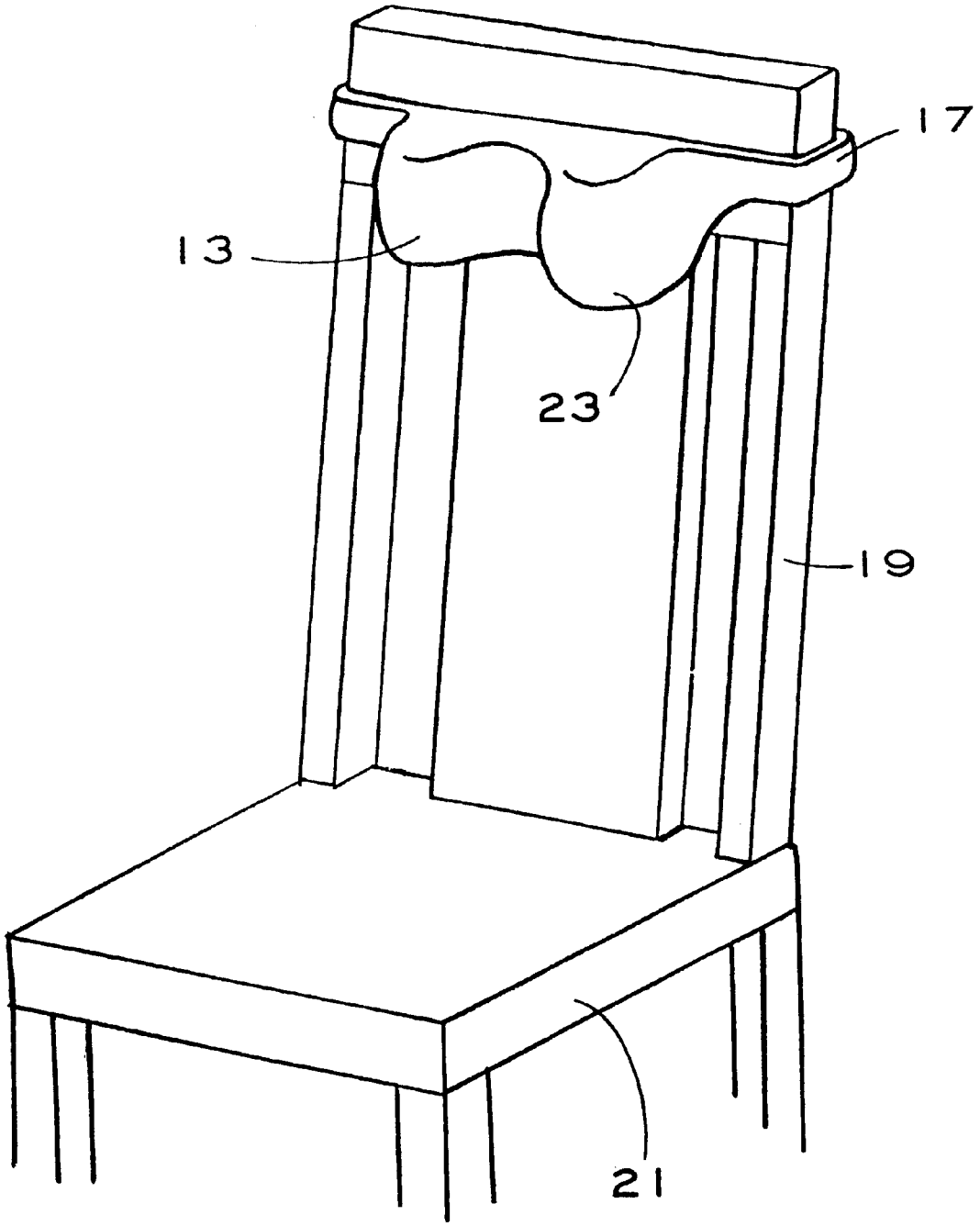
FIG. 3 is a perspective view of the upper portion of a chair with a cervical pad affixed to the top of back of the chair by the arms being bent about the chair back in the manner shown in FIG. 1*c*.
Figure 4:
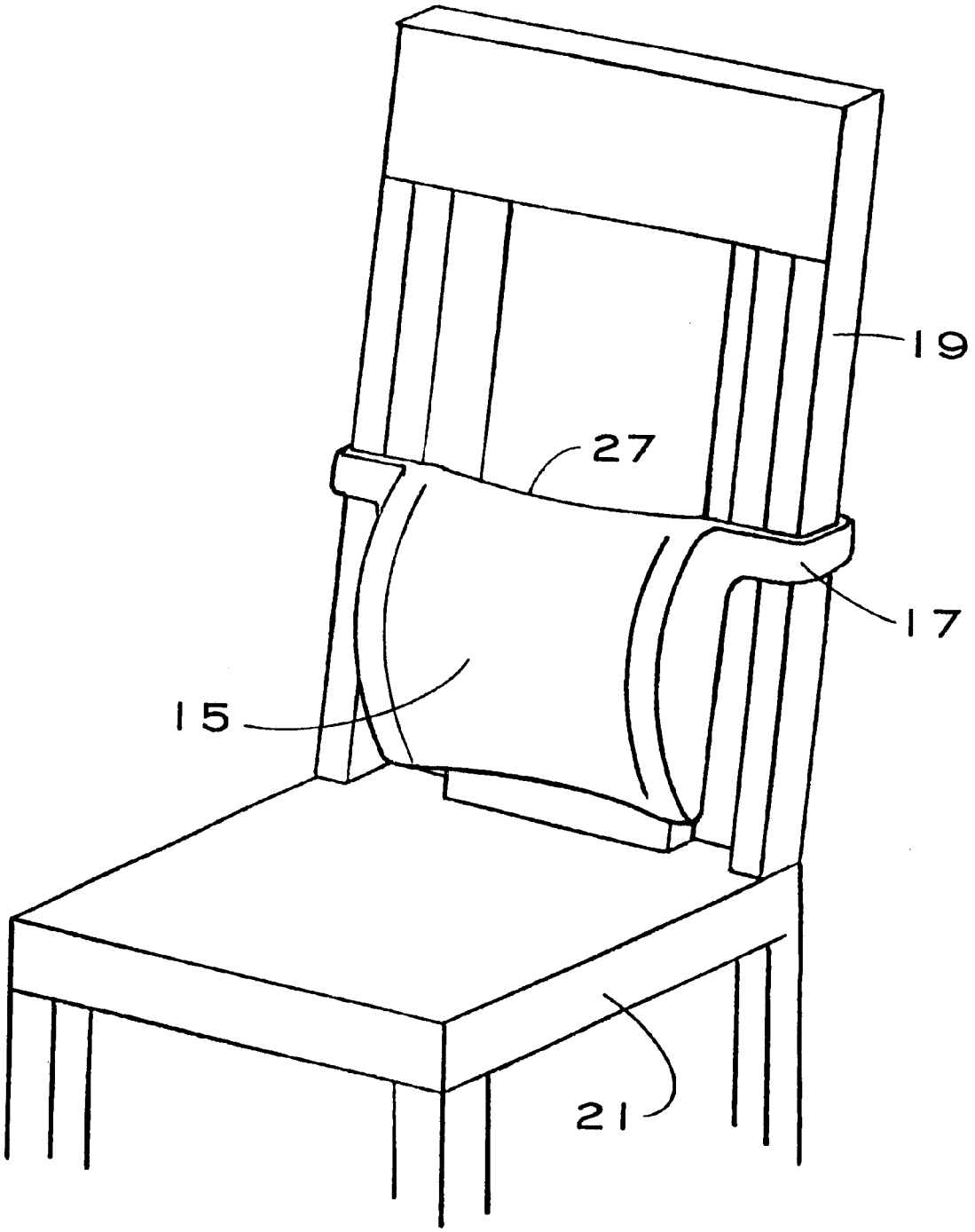
FIG. 4 is a perspective view of the upper portion of a chair with a lumbar pad affixed to the back of the chair by the arms being bent about the chair back in the manner shown in FIG. 2*a*.

In FIG. 3, the cervical pad 13 is shown using the arms 17 as bent in FIG 1*c* to hold the cervical pad 13 on the back 19 of a chair 21. Similarly, in FIG. 4, the lumbar pad 15 is shown as being held on the back 19 of a chair 21 using the arms 17 bent as shown in FIG. 2*a*. The posture system permits the use of any one posture pad 11 while also permitting the use of a plurality of posture pads 11, namely both a lumbar pad 15 and a cervical pad 13. Each posture pad 11 has arms 17 which may be bent to wrap around the back 19 of a chair 21. In this way, either the lumbar pad 15 or the cervical pad 13 or both such posture pads 11 may be used without any other parts of the posture system.

Figure 5:
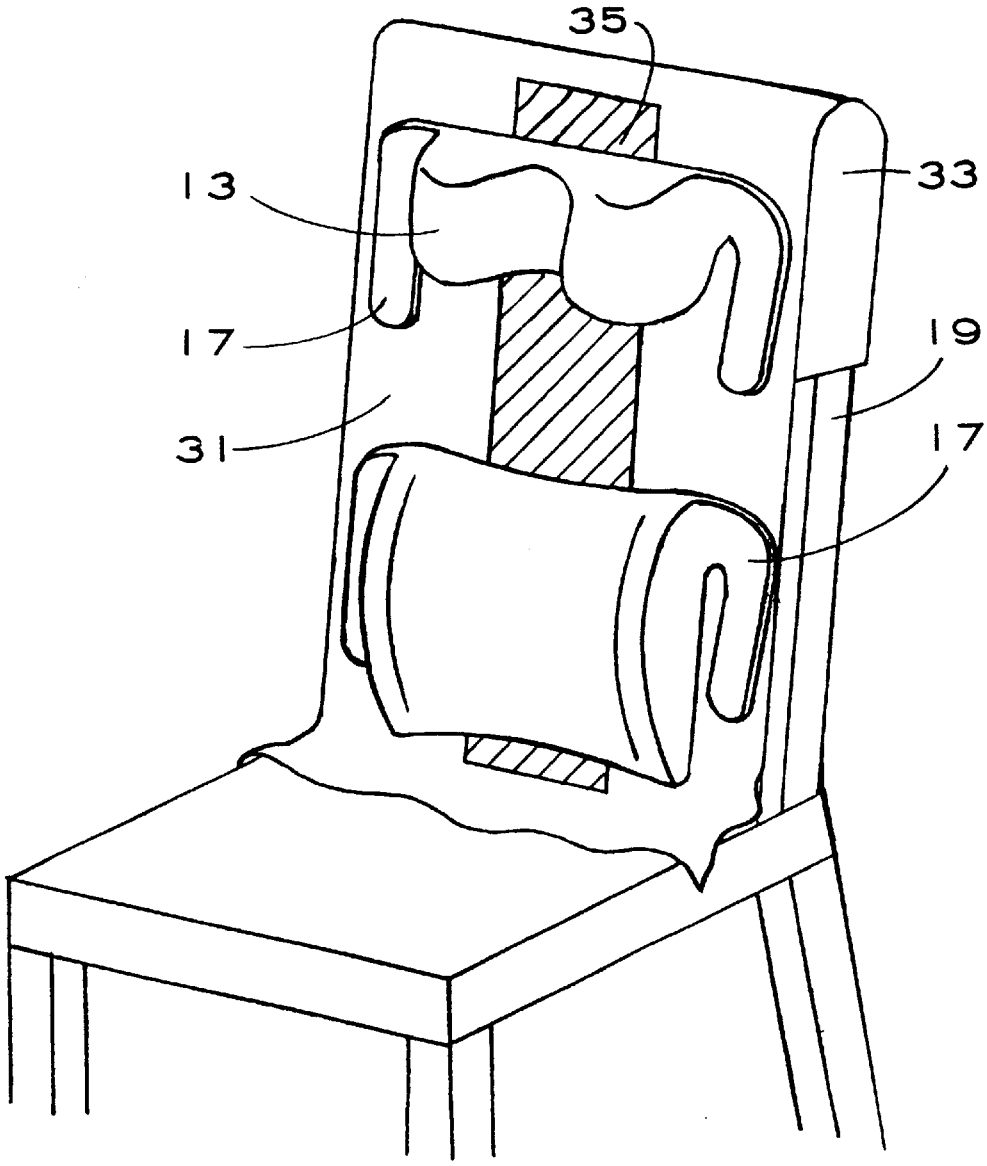
FIG. 5 is a perspective view of the upper portion of a chair showing both a cervical pad and a lumbar pad mounted on the back cover of the carrier by means of hook and loop material on the back cover with the pocket of the carrier placed over the top back of the chair.

In FIG. 5, a chair 21 with a back 19 is shown with a back cover 31 against the back 19 and with a pocket 33 over the back 19 of the chair 21. The back cover 31 and pocket 33 serve as the carrier for the posture system. The lumbar pad 15 and the cervical pad 13 may be folded into the back cover 31 and then rolled into the pocket 33 for carrying.

On the back cover 31 is a strip of hook and loop material 35. The strip of hook and loop material 35 is located down the center of the back cover 31 so that when the pocket 33 is over the back 19 of the chair 21, the strip of hook and loop material 35 is generally vertical and generally along the center of the chair 21. On the back 29 of the lumbar pad 15 and on the back 37 of the cervical pad 13, a strip of hook and loop material 35 is mounted, which hook and loop material 35 is located down the center of the backs 29,37 of both the cervical pad 13 and the lumbar pad 15 to align with the strip of hook and loop material 35 on the back cover 31. Hook and loop material 35 requires two mating sections, one of which is soft and the other is far more course. To avoid irritation to the back of anyone sitting in the chair 21 from the hook and loop material 35, the soft section is placed on the back cover 31.

As shown in FIG. 5, the arms 17 of the cervical pad 13 and the lumbar pad 15 are bent down and are not used to hold either the cervical pad 13 or the lumbar pad 15 on the back 19 of the chair 21 since the hook and loop material 35 is providing the necessary retention with the back cover 31 and pocket 33. It should be noted that consistent with the flexibility of the posture system, only one posture pad 11 may be used as well as a plurality of posture pads 11. Since the hook and loop material 35 is present, the arms 17 need not be used, but, if additional retention of a posture pad 11 is desired, the arms 17 may be used with the hook and loop material 35.

To use the cervical pad 13, the chair 21 being used must have a sufficiently high back 19. The lumbar pad 15 may be used in virtually any chair 21. Fortunately, in planes, trains and busses, where the need for posture devices is the greatest, the backs 19 of the chairs 21 are sufficiently high for the cervical pad 13 to be utilized. In some situations, the chair 21 is just too wide for the arms 17 on the posture pad 11 to be used while, with other chairs 21, the pocket 33 may not firmly hold on the back 19 of the chair 21. Thus, the availability of having alternate methods of mounting the lumbar pad and cervical pad and also just one posture pad, on a chair provides the greatest flexibility for use in a variety of places and with varying needs.

The arms 17 on the lumbar pad 15 extends from the back 29 of the lumbar pad 15 adjacent the upper edge 27 of the lumbar pad 15. The cervical pad 13 also has an upper edge 39 and the arms 17 on the cervical pad 13 extend, similarly to the lumbar pad 15, from the back 37 of the cervical pad 13 adjacent the upper edge 39 of the cervical pad 13.

Figure 6:
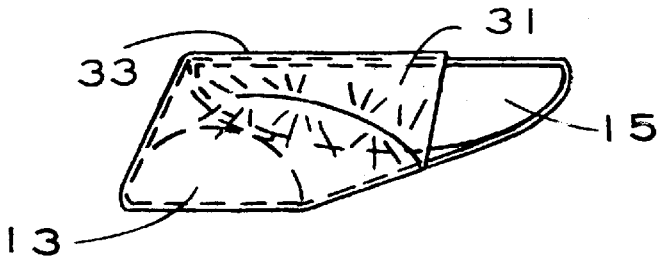
FIG. 6 is a sectional view showing the cervical pad and the lumbar pad folded with back cover into the pocket for carrying both pads in the carrier.
Figure 7:
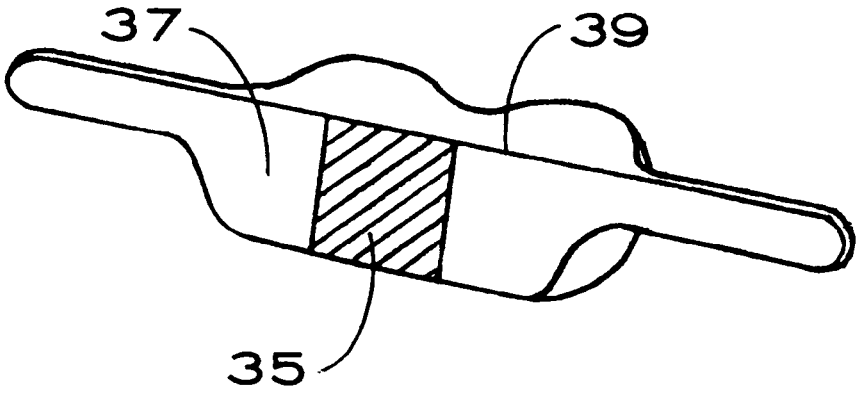
FIG. 7 is a rear elevation of the cervical pad showing the arms stretched out and showing hook and loop material mounted vertically along the center of the back.
Figure 8:
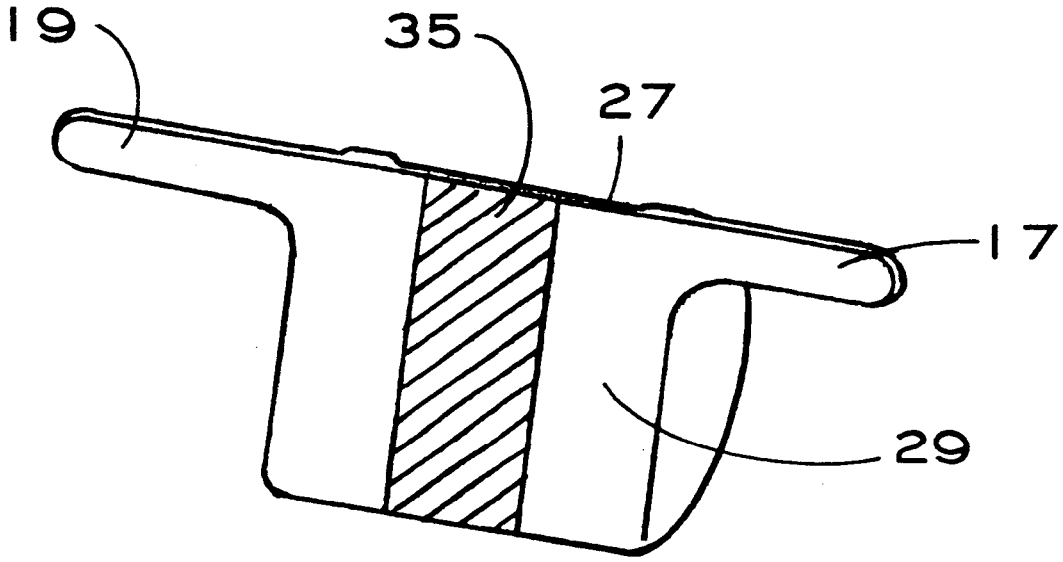
FIG. 8. is a rear elevation of the lumbar pad showing the arms stretched out and showing hook and loop material mounted vertically along the center of the back.

In FIG. 6 is shown the lumbar pad 15 and the cervical pad 13 folded in to the back cover 31 and then folded into the pocket 33. In this way the entire posture system can be readily carried.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A portable posture system for mounting on a chair with a back, the back having an upper end, comprising:

a cervical pad having a pair of arms, the arms adapted to bend and to hold a desired position;

a lumbar pad having a pair of arms, the arms being adapted to bend and to hold a desired position;

a back cover for covering the back of the chair, the back cover including a pocket, the pocket being at one end of the back cover for detachable securement to the upper end of the back of the chair, the back cover and pocket serving as a carrier case for the portable Posture system; and hook and loop material on the back cover and on the cervical pad and the lumbar pad to secure the lumbar pad and the cervical pad to the back cover, the arms being bent about the back of the chair, the lumbar pad and the cervical pad being adapted to be folded into the back cover and being placed with the back cover into the pocket for carrying.

2. A portable posture system comprising:

a posture pad having a front surface, a back surface which is flat, two side surfaces and two side edges, a top edge and a bottom edge and including arms extending from the back surface adjacent the top edge, the arms being adapted to bend and to hold a desired position to retain the posture pad in place.

3. A portable posture system according to claim 2 wherein the posture pad is a cervical pad.

4. A portable posture system according to claim 2 wherein the posture pad is a lumbar pad.

5. A portable posture system according to claim 2 further including:

a back cover for covering the back of the chair, the back cover including a pocket, the pocket being at one end of the back cover for detachable securement to the upper end of the back of the chair, the back cover and pocket serving as a carrier case for the portable posture system;

hook and loop material on the back cover and on the posture pad to secure the posture pad to the back cover.

6. A portable posture system according to claim 2 further comprising:

a back cover for covering the back of the chair, the back cover including a pocket, the pocket being at one end of the back cover for detachable securement to the upper end of the back of the chair, the back cover and pocket serving as a carrier case for the portable posture system;

hook and loop material on the back cover and on the posture pad to secure the posture pad the to the back cover, the posture pad being a lumbar pad.

7. A portable posture system according to claim 2 further comprising:

a back cover for covering the back of the chair, the back cover including a pocket, the pocket being at one end of the back cover for detachable securement to the upper end of the back of the chair, the back cover and pocket serving as a carrier case for the portable posture system;

hook and loop material on the back cover and on the posture pad to secure the posture pad the back cover, the posture pad being a cervical pad.

8. A portable posture system for mounting on a chair with a back, the back having an upper end, comprising:

a posture pad, the posture Pad including arms, the arms being adapted to bend and to hold a desired position;

a back cover for covering the back of the chair, the back cover including a pocket, the pocket being at one end of the back cover for detachable securement to the upper end of the back of the chair, the back cover and pocket serving as a carrier case for the portable posture system; and hook and loop material on the back cover and on the posture pad to secure the posture pad to the back cover, the posture pad being adapted to fold into the back cover and to be placed with the back cover into the pocket for carrying.

* * * * *